United States Patent [19]

Asari et al.

[11] Patent Number: 4,744,236

[45] Date of Patent: May 17, 1988

[54] METHOD OF AND APPARATUS FOR INDIRECT EXTRUSION

[75] Inventors: Akira Asari, Osaka; Masakazu Ueda, Kobe; Takahisa Tabuchi, Kobe; Munenori Soejima, Kobe; Toshio Kurosaki, Akashi; Masaru Sugamoto, Kobe, all of Japan

[73] Assignee: Kabushiki Kaisha Kobeseikosho, Kobe, Japan

[21] Appl. No.: 811,960

[22] PCT Filed: Apr. 18, 1985

[86] PCT No.: PCT/JP85/00215

§ 371 Date: Dec. 10, 1985

§ 102(e) Date: Dec. 10, 1985

[87] PCT Pub. No.: WO85/04825

PCT Pub. Date: Nov. 7, 1985

[30] Foreign Application Priority Data

| | | | |
|---|---|---|---|
| Apr. 20, 1984 | [JP] | Japan | 59-58949 |
| Apr. 25, 1984 | [JP] | Japan | 59-84814 |
| Jun. 12, 1984 | [JP] | Japan | 59-87754 |

[51] Int. Cl.[4] ..... B21C 23/00; B21C 26/00; B21C 35/04

[52] U.S. Cl. ..... 72/273.5; 72/255; 72/265; 72/273

[58] Field of Search ..... 72/253.1, 255, 264, 72/265, 273.5, 270, 273, 263

[56] References Cited

U.S. PATENT DOCUMENTS

| | | | |
|---|---|---|---|
| 2,063,563 | 12/1936 | Sparks | 72/273.5 |
| 2,639,810 | 5/1953 | Doan | 72/270 |
| 3,184,944 | 5/1965 | Sibler | 72/273.5 |
| 3,563,079 | 2/1971 | Monie et al. | 72/273.5 |
| 3,738,144 | 6/1973 | Doudet . | |
| 3,805,574 | 4/1974 | Wessel | 72/265 |
| 4,052,877 | 10/1977 | Zilges . | |
| 4,059,896 | 11/1977 | Asari et al. | 72/253.1 |
| 4,165,625 | 8/1979 | Wagner et al. . | |
| 4,345,450 | 8/1982 | Doudet . | |
| 4,365,497 | 12/1982 | Asari | 72/263 |
| 4,557,131 | 12/1985 | Wagner | 72/273 |

FOREIGN PATENT DOCUMENTS

| | | | |
|---|---|---|---|
| 0114571 | 12/1983 | European Pat. Off. . | |
| 1387870 | 12/1965 | France . | |
| 35541 | 10/1976 | Japan | 72/273.5 |
| 52-752 | 1/1977 | Japan | 72/273.5 |
| 3048 | 6/1977 | Japan | 72/273.5 |
| 62538 | 1/1979 | Japan | 72/273.5 |
| 14413 | 4/1980 | Japan | 72/273.5 |
| 55-14413 | 4/1980 | Japan | 72/273.5 |
| 206116 | 11/1984 | Japan | 72/273.5 |
| 1121599 | 7/1968 | United Kingdom . | |

*Primary Examiner*—Lowell A. Larson

*Attorney, Agent, or Firm*—Oblon, Fisher, Spivak, McClelland & Maier

[57] ABSTRACT

Double-stem type extrusion method and apparatus used for extrusion-molding rod-like and tubular products. In order to upset a solid or hollow billet (5, 5A) supplied to a container (1), the end of the container (1) which is on the side of a press stem (6) is closed with a blistering-preventing cover (11) which is not moved relatively to the container (1). A pressure is then applied to the billet (5, 5A) from the side of a die (8) to start the yield deformation thereof from the same side thereof. As the yield deformation movement of the billet (5, 5A) progresses, the air existing between the inner surface of the container and billet (5, 5A) is discharged from the portion of the container (1) which is on the side of the cover (11).

4 Claims, 16 Drawing Sheets

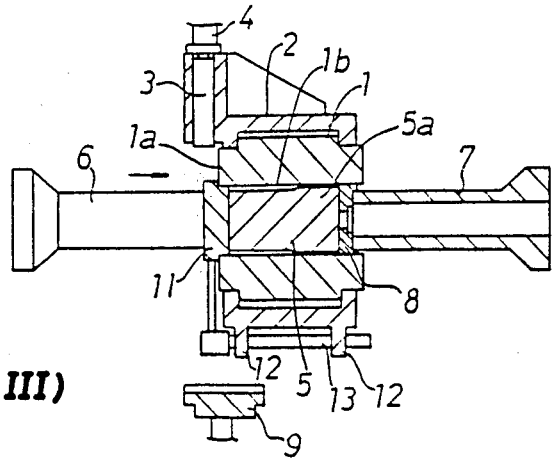
FIG. 1(III)

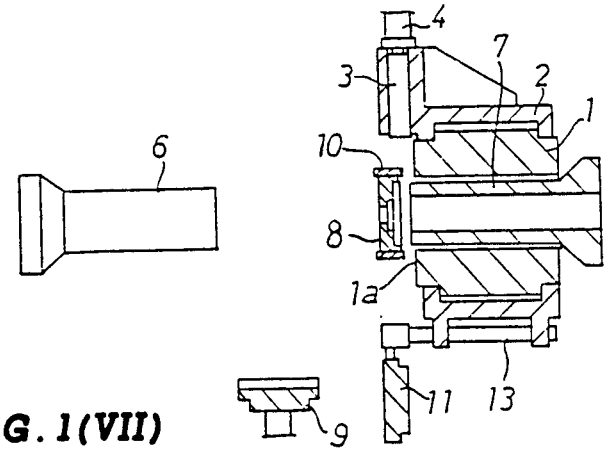
FIG. 1(VII)

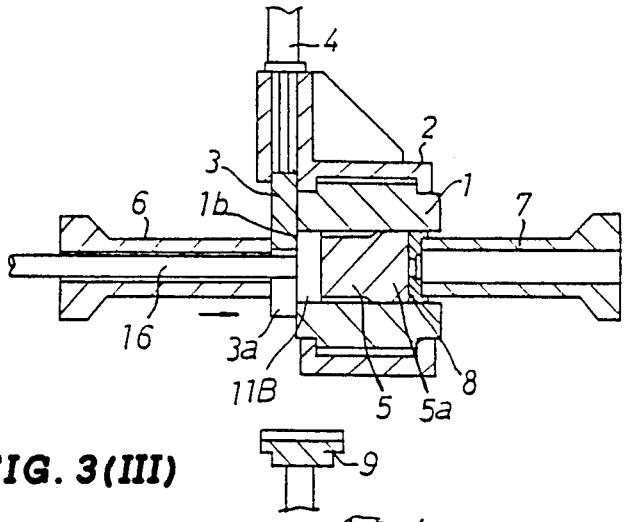
FIG. 3(III)

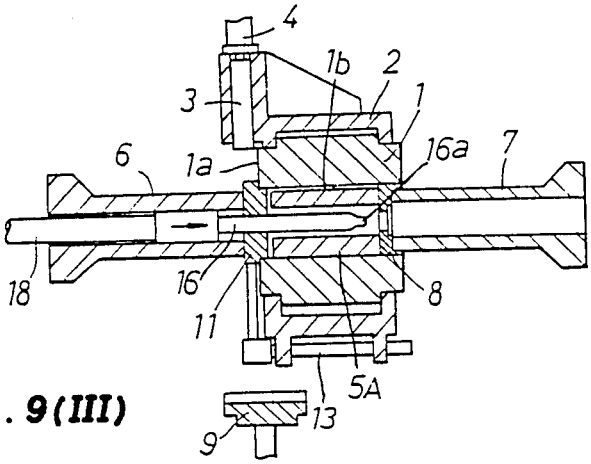
FIG. 9(III)

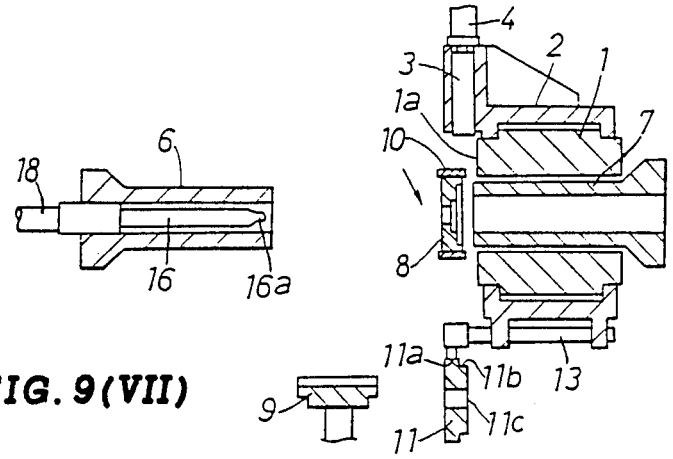
FIG. 9(VII)

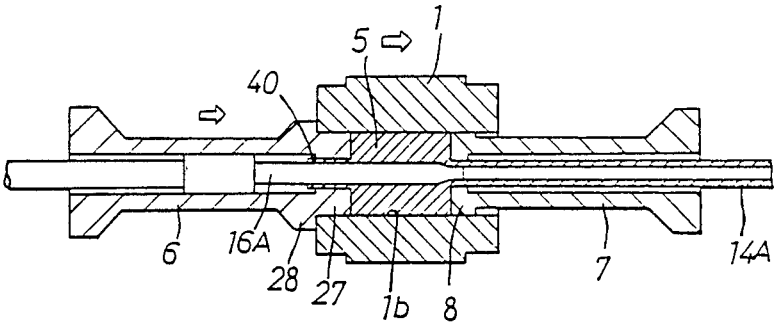
FIG. 26 (I)
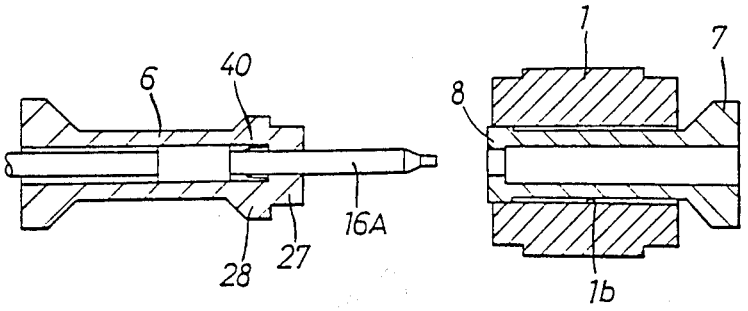
FIG. 26 (II)

METHOD OF AND APPARATUS FOR INDIRECT EXTRUSION

TECHNICAL FIELD

The present invention relates to an indirect extrusion method for an indirect extrusion press of the double stem type wherein the billet placed into the container can be upset while effectively preventing blistering due to the presence of remaining air in the container and by which the billet can be extruded smoothly, the invention relating also to a device for the method.

BACKGROUND ART

Unexamined Japanese Patent Publication Nos. SHO 56-165515 and SHO 54-54957, Unexamined Japanese Utility Model Publications Nos. SHO 54-5798 and SHO 54-62538, etc. each disclose double-stem indirect extrusion presses of prior art which comprise a billet accommodating container, and a press stem and a die stem arranged on the center line of extrusion on opposite sides of the container and by which a billet (solid or hollow) placed into the container is upset by the two stems in pressing contact with the opposite ends of the billet and extruded into a rod or tubular product through a die on the die stem by subsequently moving both the press stem and the container together toward the die stem and causing the press stem to apply pressure on the billet. Now, with reference to FIG. 1 showing an indirect extruder of the invention, the structure and operation of the press will be described generally. Arranged on the center line of extrusion X—X in FIG. 1(I) are a press platen thereof, although these members are not shown. The two members are connected together by tie rods. The press platen is provided with a die stem 7 as illustrated which is fixed with respect to the direction of the extrusion center line X—X. Although unillustrated, the press frame on the other side is provided with a series of extrusion pressure applying means, such as main cylinder, main ram and crosshead, as already known. The crosshead is provided with a press stem 6 as shown which is movable forward or backward along the extrusion center line X—X for the application of pressure as illustrated. Interposed between the press stem 6 and the die stem 7 is a container 1 mounted on a container holder 2 which is movable forward or backward along the extrusion center line X—X by an unillustrated container hydraulic coupling cylinder or like shift cylinder. A solid or hollow billet 5 is supplied to the container 1, for example, by an illustrated movable billet loader 9 or the like. FIG. 1(I) shows no die for the die stem 7 because a die 8 can be removably attached thereto by a die handling robot 10 or the like as seen in FIG. 1(II). The die stem 7 may of course have the die 8 as attached to its front end in advance to achieve the same result. Disposed at the rear end of the container holder 2 is a shearing device comprising a shear blade 3 and a shear cylinder 4 as already known. With such an indirect extrusion press of the double stem type, the billet 5 is first positioned in alignment with the center line X—X by the billet loader 9, then placed into the container 1, for example, by moving the container 1, thereafter upset by the press stem 6 and the die stem 7 at the opposite ends of the billet 5, and extruded into a rod product or the like through the die 8 on the die stem 7 by subsequently moving the container 1 and the press stem 6 together toward the die stem 7. A tubular product is similarly obtained by using a hollow billet and a mandrel arranged in the die stem 7 concentrically therewith, or by using a solid billet and a piercing mandrel or the like, as already known. The extrusion press of this type, although generally used for producing rods and tubes, has the following problems.

With the indirect extrusion press of the prior-art double stem type, the billet 5 in the container 1 is upset by the pressure applied by the two stems 6 and 7 to the billet ends axially thereof, so that the yield phenomenon of the billet takes place first at the opposite billet ends. Consequently, the air present in the space between the inner surface of the container 1 and the other surface of the billet 5 (especially, the air remaining in the midportion of the space) fails to escape, thus blistering the surface of the extruded product owing to the remaining air and degrading the surface of the product. To eliminate this drawback, a taper heating method is used in which the billet 5 is locally heated to a higher temperature toward the die stem 7, but the method is not fully effective for elongated billets or for billets to be extruded at a small ratio, while the method required providing equipment for operation.

While the extrusion of a solid billet into a rod product has been described, similar problems are encountered in extruding a hollow billet into a tubular product or in extruding a solid billet into a tubular product by piercing.

OBJECTS OF THE INVENTION

The main object of the present invention is to provide an indirect extrusion method of extruding billets into rods or tubes by an indirect extrusion press of the double stem type wherein the yield deformation of the billet is started at one end thereof toward the die when the billet is upset so that the air present in the container around the billet is allowed to escape from the end of the container opposite to the die to eliminate the blistering phenomenon due to confined air and to obtain an extrusion product with a satisfactory surface quality. The invention also contemplates provision of an apparatus for the method.

In addition to the above main object, another object of the present invention is to provide an indirect extrusion apparatus wherein the shell separated off and remaining in the press stem is readily removable therefrom.

SUMMARY OF THE INVENTION

In extruding a billet into a rod or tubular product with use of an indirect extrusion press of the double-stem type which comprises a press stem and a die stem arranged in opposed relation to each other on the center line of extrusion on opposite sides of a billet accommodating container and in which the billet is placed into the container, then upset by the two stems and thereafter extruded through a die on the forward end of the die stem by moving the container and the press stem together toward the die stem, an indirect extrusion method according to a first feature of the present invention is characterized by closing one end of the container toward the press stem with a blister preventing closure which is immovable relative to the container when the billet is to be upset, and thereafter applying a pressure to the billet from the die side to cause the billet to start yield deformation from the die side thereof, whereby air present between the inner surface of the container and the billet is released from the closure side with the progress of the yield deformation As used herein, the expressions "blister preventing closure" and "blister preventing closure means" refer to a large-diameter portion of the press stem and a dummy block mountable on (either integral with or detachably mountable on) the large-diameter portion of the press stem. The blister preventing closure means comprises a distal cylindrical portion and a proximal cylindrical portion. The proximal and distal cylindrical portions are concentric to one another and are joined by a planar annular shoulder of the entirety of which is flat and perpendicular to the center line of extrusion. The proximal cylindrical portion has an outer diameter that is not fittable in the opening in the billet accommodating container, and the distal cylindrical portion has an outer diameter portion that is fittable in the opening in the billet accommodating container and a working surface that comes into contact with the billet during use of the indirect extrusion press. The entirety of the working face is flat and perpendicular to the center line of extrusion.

According to a second feature of the present invention, there is provided an indirect extrusion method for extruding a hollow billet into a tubular product by an indirect extrusion press of the double-stem type which comprises a press stem and a die stem arranged in opposed relation to each other on the center line of extrusion on opposite sides of a billet accommodating container, the press stem having a mandrel concentrically extending therethrough, and in which the billet is placed into the container, then upset by the two stems and thereafter extruded through a die on the forward end of the die stem by moving the container and the press stem together toward the die stem, the method being characterized by bringing a blister preventing closure into contact with one end of the container toward the press stem when the billet is to be upset, the closure being larger than the billet inserting opening of the container at said end thereof, having a mandrel passing hole and being immovable relative to the container, and thereafter applying a pressure to the billet from the die side to cause the billet to start yield deformation from the die side thereof, whereby air present between the inner surface of the container and the billet is released from the closure side with the progress of the yield deformation.

According to a third feature of the present invention, there is provided an indirect extrusion method for extruding a billet into a tubular product by an indirect extrusion press of the double-stem type which comprises a press stem and die stem arranged in opposed relation to each other on the center line of extrusion on opposite sides of a billet accommodating container, the press stem having a piercing mandrel concentrically extending therethrough, and in which the billet is placed into the container, then upset and pierced by the piercing mandrel and thereafter extruded through a die on the forward end of the die stem by moving the container and the press stem together toward the die stem, the method being characterized by upsetting the billet by the press stem and the die stem while moving the press stem and the container together, with a container-engaging, large-diameter portion of the press stem in engagement with the rear end of the container, the large-diameter portion being diametrically larger than the inside diameter of the container and provided at the billet pressing end of the press stem, thereafter piercing the billet by the piercing mandrel with the press stem retracted by an amount corresponding to the amount of backflow of the billet due to the piercing, and extruding the billet into a tubular product by moving the press stem and the container while a specified clearance formed by the retraction of the press stem is maintained between the large-diameter portion and the rear surface of the container.

According to a fourth feature of the present invention, there is provided an indirect extrusion press of the double-stem type which comprises a press stem and a die stem arranged in opposed relation to each other on the center line of extrusion on opposite sides of a billet accommodating container and in which a billet placed into the container is upset by the two stems and thereafter extruded through a die on the forward end of the die stem by moving the container and the press stem together toward the die stem, the indirect extrusion press being characterized in that a blister preventing closure larger than the billet inserting opening of the container at the end thereof toward the press stem is provided between the press stem and the container for selectively closing said container end when coming into contact therewith.

According to a fifth feature of the present invention, there is provided an indirect extrusion press of the double-stem type which comprises a press stem and a die stem arranged in opposed relation to each other on the center line of extrusion on opposite sides of a billet accommodating container and in which a billet placed into the container is upset by the two stems and thereafter extruded through a die on the forward end of the die stem by moving the container and the press stem together toward the die stem, the indirect extrusion press being characterized in that a blister preventing closure is provided integrally with the forward end of the press stem, the closure being larger than the billet inserting opening of the container at the pressing side thereof for closing the inserting opening.

According to a sixth feature of the invention, there is provided an indirect extrusion press of the double-stem type for forming a tubular product by extrusion which comprises a press stem and a die stem arranged in opposed relation to each other on the center line of extrusion on opposite sides of a billet accommodating container and in which a billet placed into the container is upset by the two stems and thereafter extruded through a die on the forward end of the die stem by moving the container and the press stem together toward the die stem, the indirect extrusion press being characterized in that a blister preventing closure comprises a large-diameter portion of the press stem and a dummy block joinable to or separable from the large-diameter portion, the press stem having an inner peripheral surface extending straight in parallel with the pressing direction and having a diameter larger than the diameter of the mandrel of a mandrel assembly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a fragmentary view in section showing another one of the embodiments in an upsetting state, FIGS. 3(I) to (VI) are fragmentary views in section showing the press cycle motions of another one of the embodiments, and FIG. 4 to FIG. 8 are fragmentary views in section showing others of the embodiments in an upsetting state;

FIG. 10 to FIG. 14 are fragmentary views in section showing other embodiments in an upsetting state;

FIGS. 26(I) and (II) are fragmentary views in section showing the remaining shell.

BEST MODE OF CARRYING OUT THE INVENTION

The present invention will be described below in detail with reference to the illustrated embodiments.

FIG. 1 to FIG. 8 show embodiments of the invention as indirect extrusion presses of the double-stem type for extruding a solid billet into a rod product as disclosed, for example, in Unexamined Japanese Patent Publication No. SHO 56-165515.

Figure 1I:
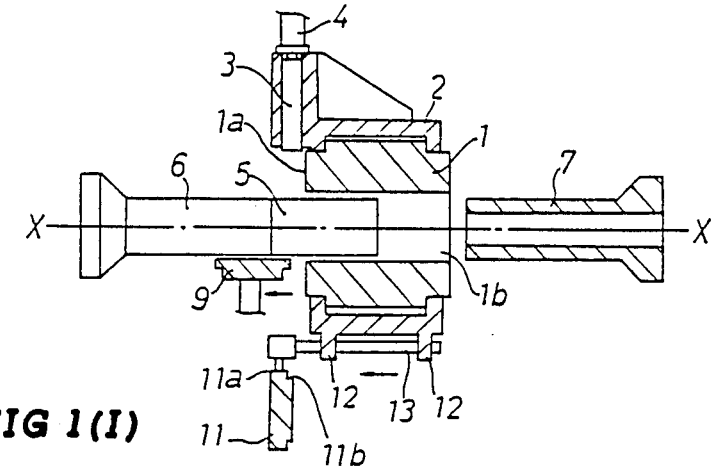
FIG. 1 to FIG. 8 show embodiments of the present invention for extruding a solid billet into a rod product, wherein FIGS. 1(I) to (VII) are fragmentary views in section showing press cycle motions.
Figure 1:
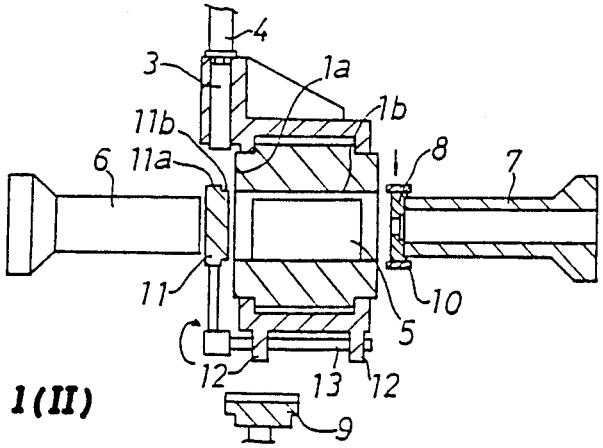
Figure 1:
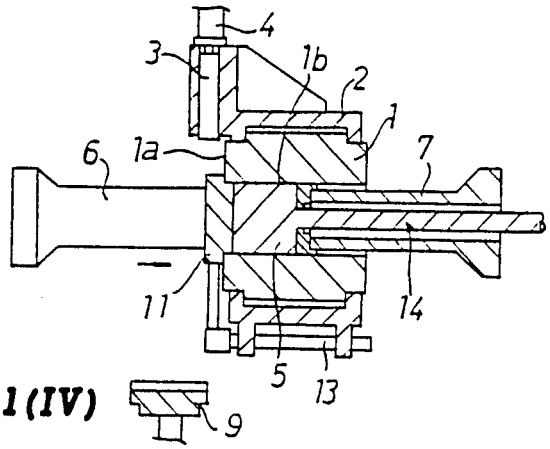
Figure 1V:
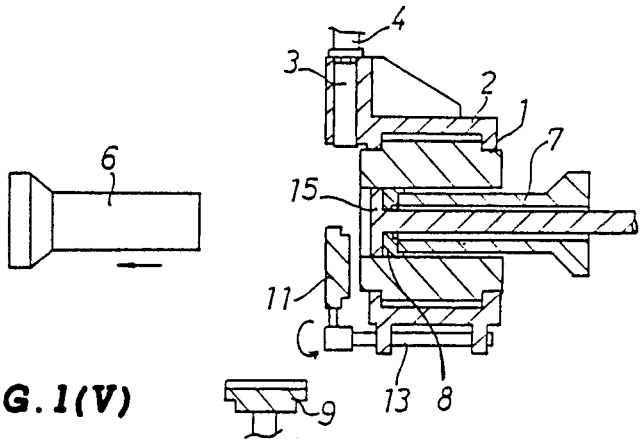
Figure 1:
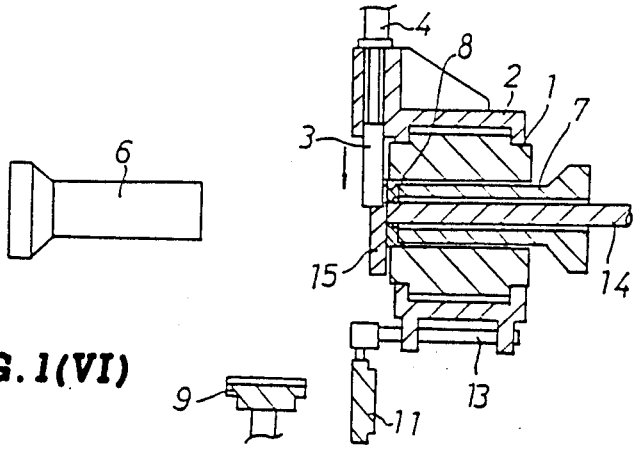

With the embodiment shown in FIG. 1, a blister preventing closure 11 according to the present invention is provided as a specific member independent of any of press stem 6, die stem 7, container 1 and container holder 2. FIGS. 1(I) to (VII) show the stages of the press cycle motion of the embodiment. Illustrated in FIG. 1(I), which shows a billet being supplied, are the container 1, the container holder 2 supporting the container 1, a shearing (cutting) device comprising a shear blade 3 and a shear cylinder 4, the press stem 6, and the die stem 7 having a die 8, the stems being arranged in opposed relation to each other on the center line of extrusion X—X. These components are the essential components of the indirect extrusion press of the double-stem type which are the same at those already described with reference to the prior art. According to the invention, the container holder 2 has bearing portions 12, 12, which support a holder rod 13 rotatably about its own axis and movable axially thereof. The blister preventing closure 11 is fixed to the holder rod 13. The closure 11 is in the form of a disk which is stepped to provide a large-diameter portion 11*a* and a small-diameter portion 11*b*. The small-diameter portion 11*b* is diametrically so dimensioned as to fit in one end of a billet inserting bore 1*b* of the container 1 at its end 1*a* opposed to the press stem 6. The large-diameter portion 11*a* is so dimensioned as to completely engage with the end face 1*a* surrounding the bore 1*b* to close the bore and of course has a larger diameter than the forward end of the press stem 6 which is diametrically smaller than the opening of the bore 1*b*. FIG. 1(I) shows a billet 5 as it is inserted into the container 1 of the present embodiments by causing a billet loader 9 to feed the billet in alignment with the center line X—X with the press stem 6 in a retracted position, advancing the press stem 6 to place the billet 5 into the container 1 and causing the container holder 2 to move the container 1 in the direction of arrow with the advance of the press stem. Subsequently after the billet 5 has been fed in place, the blister preventing closure 11 in a retracted position is positioned by the rotation of the holder rod 13 in a clearance formed between the press stem 6 and the container 1 by the return thereof, in alignment with the center line X—X as seen in FIG. 1(II). The die 8 is attached to the die stem 7 in a fixed position by a die handling robot 10. As seen in FIG. 1(III), the press stem 6 is then advanced toward the die stem 7 as indicated by an arrow, by pressure applying means (not shown) and including a known main cylinder, main ram, etc. At the same time, the closure 11 is fitted to the container 1 by moving the holder rod 13 axially thereof and also moving the container in the same direction. Consequently, with the small-diameter portion 11*b* of the closure 11 fitted in the billet inserting bore 1*b* and with the large-diameter portion 11*a* in engagement with the end face 1*a*, the press stem 6 backs up the closure 11 and starts upsetting the billet 5 between the closure 11 and the die 8 on the die stem 7. In this mode of upsetting, one end of the container 1 is closed with the closure 11 which does not move relative to the container 1, and pressure is applied to the billet at the other end of the container, i.e., at the die (8) side, causing the billet 5 to start yield deformation as indicated at 5*a*. The deformation proceeds toward the closure 11, progressively filling up the clearance in the container 1 around the billet 5 from the die side and thereby expelling the remaining air from the closure (11) side. The press stem 6 further applies pressure and advances after the completion of upsetting, extruding the billet 5 through the die 8 as shown in FIG. 1(IV). At this time, the container 1 and the container holder 2 of course move with the press stem 6 for indirect extrusion. The solid billet 5 is extruded into a rod product 14. On completion of extrusion, the press stem 6 is retracted, and the closure 11 is retracted axially by the holder rod 13 to open the end face 1*a* and subsequently rotated for retraction as seen in FIG. 1(V). Indicated at 15 in the drawing is a discard. Next, as shown in FIG. 1(VI), the container 1 and the container holder 2 are advanced toward the die stem 7 as by a shift cylinder (not shown) to expose the discard 15 within the container beyond the end face 1*a* of the container 1. The discard 15 is cut off by causing the shear cylinder 4 to lower the shear blade 3. Subsequently, as shown in FIG. 1(VII), the container 1 and the container holder 2 are further advanced toward the die stem 7 to expose the die 8 within the container 1 outside the end face 1*a* as illustrated, and the die 8 is gripped and brought out by the handling robot 10, whereby one cycle is completed. The container 1 and the holder 2 are returned to the initial position, followed by the step shown in FIG. 1(I) again.

Figure 2:
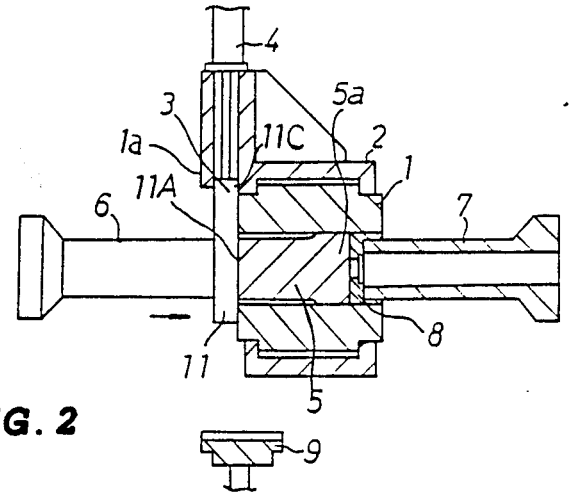

FIG. 2 shows a shearing device which is mounted on the container holder 2 and a portion of which serves as the blister preventing closure 11 of the present invention. The drawing corresponds to FIG. 1(III) and shows the upsetting step only. The press cycle motions are not shown. With reference to FIG. 2, the shearing device mounted on the container holder 2 comprises a shear blade 3 and a shear cylinder 4. According to the present invention, the shear blade 3 has one surface slidable on the end face 1*a* of the container 1 opposed to the press stem 6, and this surface serves as the surface 11*c* of the blister preventing closure in the form of a planar surface slidable on and fittable to the end face 1*a*. The press stem 6 backs up the shear blade 3 on the other surface thereof, and the stem 6 and the container 1 are moved to obtain the same upsetting action and effect as in the embodiment of FIG. 1.

Figure 3I:
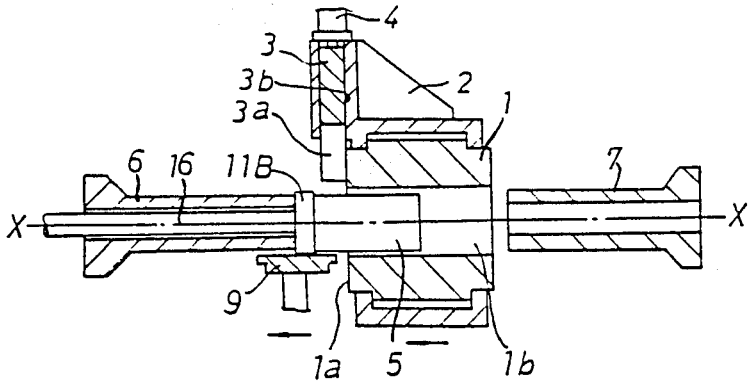
Figure 3:
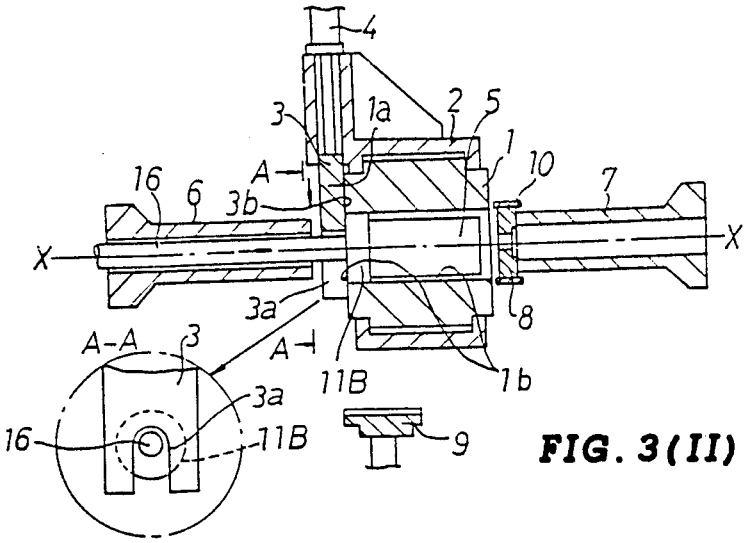
Figure 3:
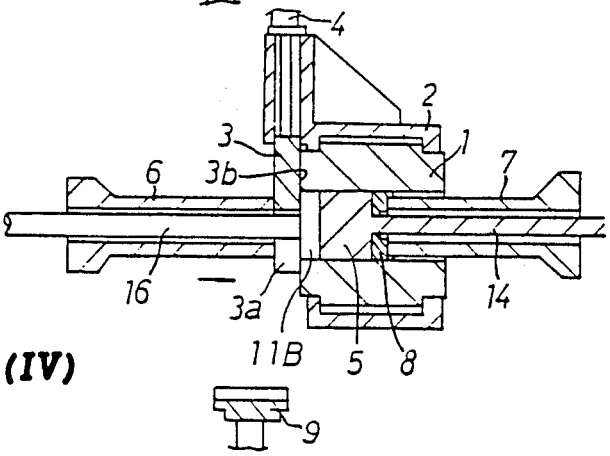
Figure 3:
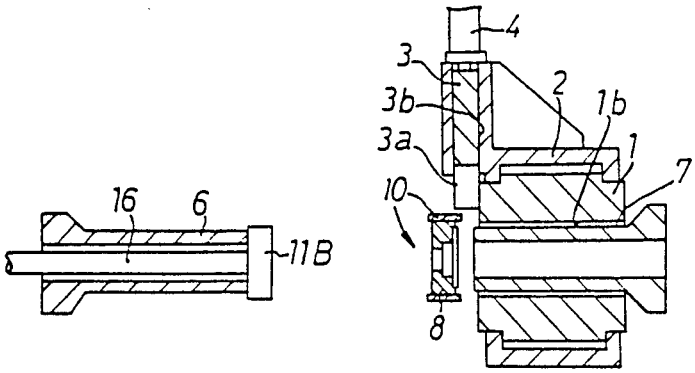

FIG. 3 shows a double-acting indirect extrusion press embodying the present invention. With such presses of the double-acting type, a mandrel is movable forward or backward in alignment with the stem 6 and together with, or independently of, the press stem 6, through a movable mandrel holder, by a cylinder provided in the main ram as already known. With presses of this type, the blister preventing closure 11 of the present invention can be provided on the mandrel side. FIGS. 3(I) to (VI) show the press in the order of press cycle motions. With reference to FIG. 3(I), indicated at 16 is a mandrel which is forwardly or rearwardly movably connected to a cylinder provided in the main ram of a main cylinder for movably supporting the press stem 6 through a crosshead although not shown. Through the crosshead and the press stem 6, the mandrel 16 is movable with or independently of the stem 6. The mandrel 16 is provided at its front end with a blister preventing closure 11B having a diameter such that it is fittable into the billet inserting bore 1*b* of a container 1. The closure 11B has a larger diameter than the press stem 6. A shearing device mounted on a container holder 2 has a shear blade 3, through which the press stem 6 backs up the closure 11B as will be described below. For this purpose, the shear blade 3 is formed with a cutout 3*a* for passing the mandrel 16 therethrough as illustrated. FIG. 3(II) shows the shape of the cutout 3*a*.

FIG. 3(I) shows a billet 5 being loaded into the container. As illustrated, the billet 5 as placed in in alignment with the center line of extrusion, X—X, by a billet loader 9 is inserted into the container 1 by the movement of the container in the direction of arrow and by being pushed in. At this time, the closure 11B at the front end of the mandrel 16 moving with the press stem 6 is positioned at the front end of the stem 6 in bearing contact with the billet 5. Next, the billet 5 is completely loaded in place by the mandrel 16 advancing independently, whereupon the closure 11B is halted at one end of the inserting bore 1*b*. At the same time, the shear blade 3 of the shearing device is lowered by the shear cylinder 4 with the mandrel accommodated in the cutout 3*a* so that one surface 3*b* of the blade covers the end face 1*a* of the container 1 including the entire surface of the closure at one end of the inserting bore 1*b* as seen in FIG. 3(II). The closure 11B is now completely set in position. From this state, the press stem 6 is advanced as indicated by an arrow in FIG. 3(III) to back up the closure 11B through the shear blade 3, and the container 1 and container holder 2 are moved with the press stem 6 toward a die stem 7 to which a die 8 is attached in the step of FIG. 3(II), whereby the billet 5 is upset by exactly the same action and effect as already stated with reference to the embodiments of FIGS. 1 and 2.

Figure 3V:
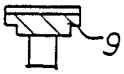
Figure 3V:
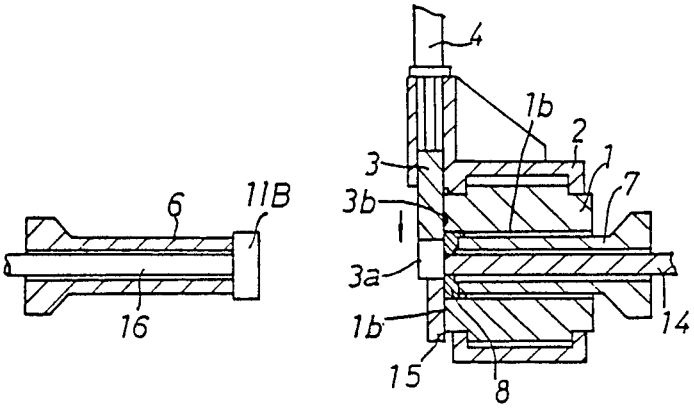

Continued movement of the press stem 6 subsequent to the completion of upsetting continuously extrudes the billet 5 through the die 8 on the die stem 7 as shown in FIG. 3(IV). On completion of extrusion when the die 8 and a discard 15 are present in the billet inserting bore 1*b* of the container at one end thereof toward the press stem 6, the shear blade 3 is first retracted upward, the mandrel 16 and the closure 11B are then retracted with the press stem 6, and the mandrel 16 is further retracted independently to position the closure 11B at the front end of the press stem 6. As shown in FIG. 3(V), the container and the container holder 2 are advanced toward the die stem 7 to expose the discard 15 within the bore 1*b* to outside of the container end face 1*a*. The discard 15 is cut off by lowering the shear blade 3 from its raised position. Next, as seen in FIG. 3(VI), the shear blade 3 is raised, the container 1 and the container holder 2 are further advanced toward the die stem 7 to project the remaining die 8 out from the container end face 1*a*, and a die handling robot 10 is caused to grip the die, whereby one cycle is completed.

Figure 4:
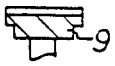
Figure 4:
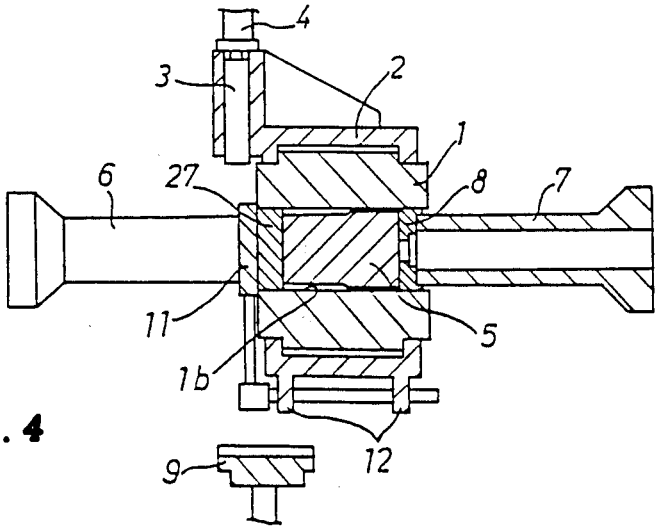
Figure 5:
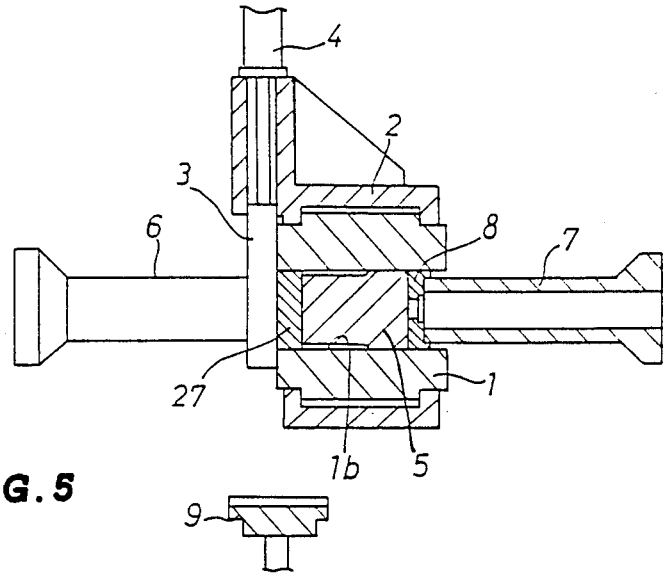

FIGS. 4 and 5 show indirect extrusion presses similar to those of FIGS. 1 and 2, in which a billet 5 and a dummy block 27 are loaded into a container 1 by a press stem 6 having a smaller diameter than the container bore, a blister preventing blind closure 11 larger than the inside diameter of the container and provided independently of the press stem 6 thereafter closes the container 1 at one end thereof toward the press stem 6, and the closure is backed up by the press stem 6. Like FIG. 1(III), FIGS. 4 and 5 show the presses in upsetting state.

FIG. 4 shows a modification of the press of FIG. 1. In these drawings, like parts are referred to by like numerals. The dummy block 27 is positioned between the billet 5 and the press stem 6 when the solid billet 5 is to be supplied, and the billet 5 and the dummy block 27 are loaded into the container 1.

FIG. 5 shows a modification of the press of FIG. 2. The shear blade 3 of the shearing device serves as the blister preventing closure.

Figure 6:
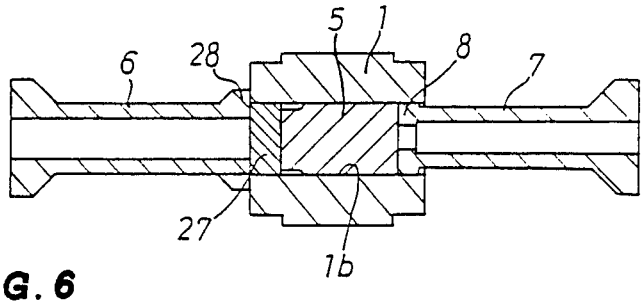
Figure 7:
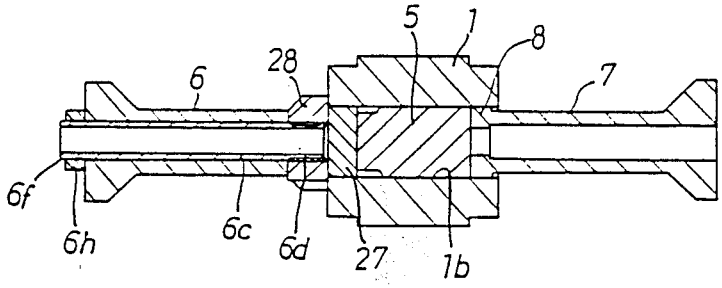
Figure 8:
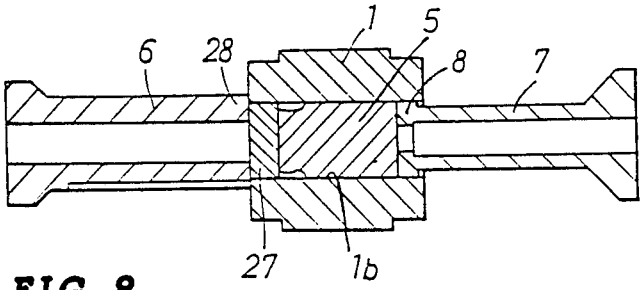

FIGS. 6, 7 and 8 show indirect extrusion presses which are similar to the one shown in FIG. 1 and comprise a press stem 6 having a large-diameter portion 28 larger than the inside diameter of the container 1, and a dummy block 27 insertable into the container. The front end of the press stem 6 and the dummy block 27 provide a blister preventing closure. FIGS. 6 to 8 are fragmentary sectional views showing the presses in an upsetting state. The press stem 6 of FIG. 6 is integral with a large diameter portion 28. With reference to FIG. 7, separate press stem 6 and large-diameter portion 28 are connected into an assembly. A sleeve 6*c* fittingly extending through the press stem 6 has an externally threaded front end 6*d* screwed into an internally threaded portion 6*e* of the dummy block 27 and an externally threaded rear end 6*f* projecting from the press stem 6 and having a nut 6*h* screwed thereon. The press stem 6 shown in FIG. 8 has an increased diameter in its entirety.

FIGS. 9 to 14 show an indirect extrusion press of the double stem type which embodies the present invention and which is adapted for extruding a hollow billet into a tubular product as disclosed in Unexamined Japanese Utility Model Publication No. SHO 54-5798.

Figure 9I:
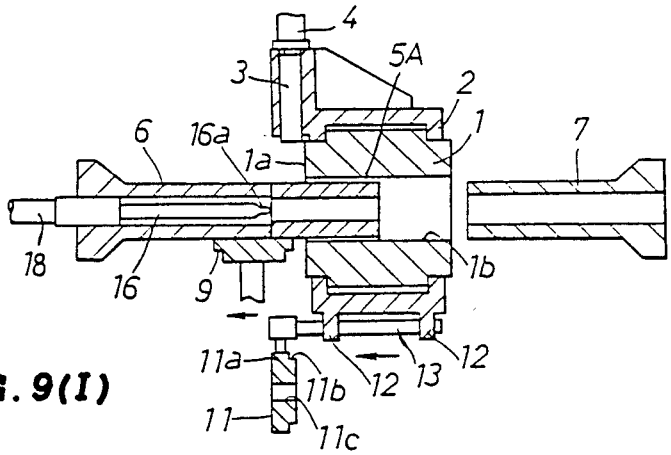
FIGS. 9(I) to (VII) are fragmentary views in section showing press cycle motions.

FIGS. 9(I) to (VII) show the states of the press in the order of press cycle motions. Throughout FIGS. 1 to 9(I), like parts are referred to by like numerals. The different feature of the present embodiment only will be described. For a hollow billet 5A, a mandrel 16 extends through a press stem 6 concentrically therewith and is formed at its front end with a core head 16*a* for determining an extrusion clearance for the tubular product when inserted into the die orifice of a die 8 on a die stem 7. The mandrel 16 is supported by a mandrel holder 18 which s movable forward or rearward by a cylinder.

Figure 9:
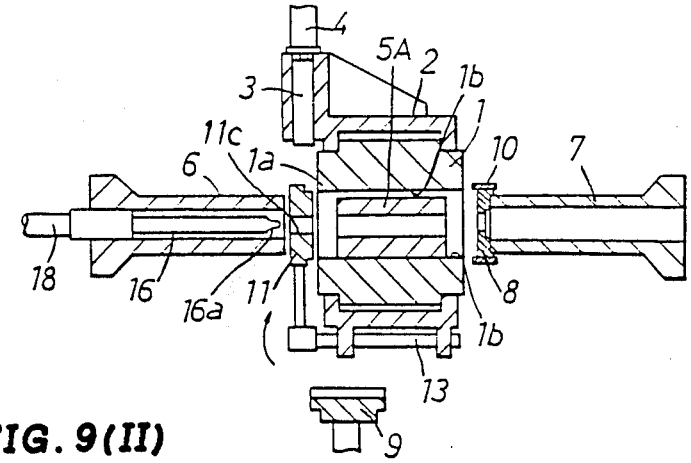
FIG. 9 to FIG. 14 show embodiments of the present invention for extruding a hollow billet into a tubular product.
Figure 9:
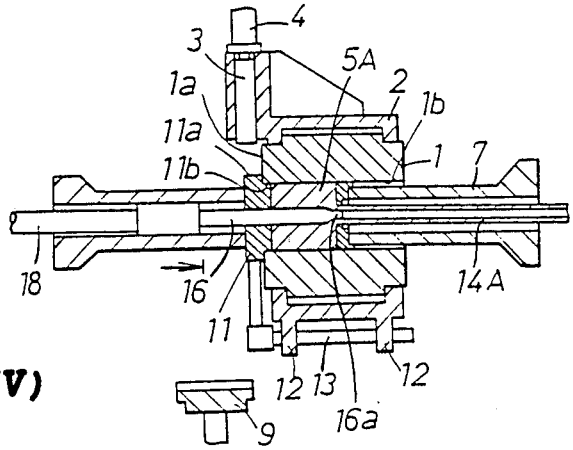
Figure 9V:
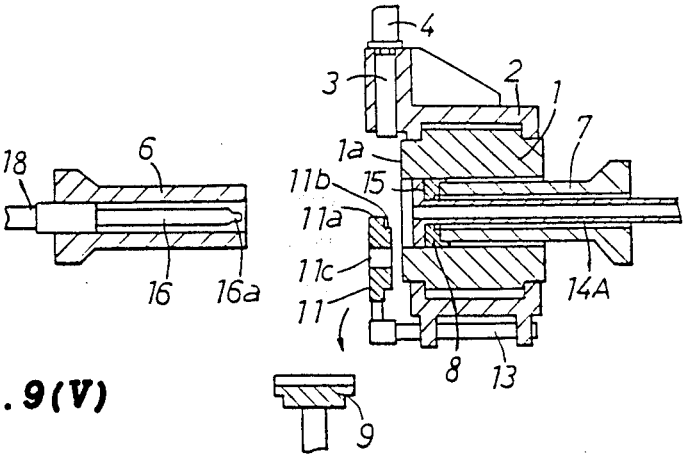
Figure 9:
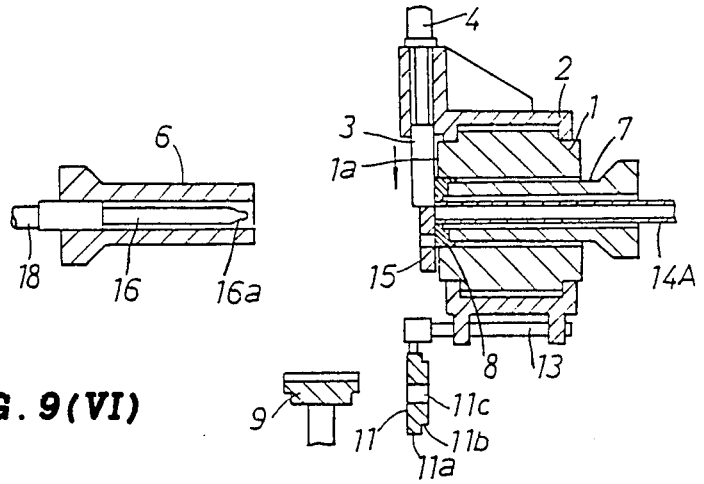

The cylinder is provided in the main ram of a main cylinder supporting the press stem 6 through a crosshead. The mandrel 16 is moveable forward or rearward with the press stem 16 or independently thereof. Like the embodiment of FIG. 1, the present embodiment includes a a blister preventing closure 11 supported by a holder rod 13 on a container holder 2 and revolvable and movable forward or rearward. The closure 11 is centrally formed with a hole 11C for passing the mandrel 16. FIG. 9(I) shows the holloe billet 5A while it is being loaded into the container 1 by the same procedure as in FIG. 1(I). Like FIG. 1(II), FIG. 9(II) shows the blister preventing closure 11 as revolved from retracted position to set position in alignment with the center line of extrusion, X—X. FIG. 9(III) shows the closure 11 in its closed position. The press stem 6 and the mandrel 16 move together to bring the closure 11 to the closed position, in which the small-diameter portion **11*b* thereof fits in one end of a billet inserting bore 1*b* with the large-diameter portion 11*a* in engagement with the end face 1*a* of the container 1. The mandrel 16 is further advanced singly. With the closure 11 thus backed up by the press stem 6, the press stem 6, the container 1 and the holder 2 are moved toward the die stem 7 equipped with the die 8, whereby the billet is upset by the same action and effect as in the foregoing embodiments of FIG. 1 et seq. FIG. 9(IV) shows the upset billet while it is being extruded. The press stem 6, the container 1 and the holder 2 advance together toward the die stem 7, with the mandrel 16 held in position, whereby the billet 5A is extruded into a tubular product 14A by the die 8 and the core head 16*a* as illustrated. The closure 11 remains at rest relative to the container 1. On completion of the extrusion, the press stem 6 and the mandrel 16 retract first as shown in FIG. 9(V), and the closure 11 is then retracted by revolving. Indicated at 15 is a discard. Subsequently, the container 1 and the container holder 2 are advanced toward the die stem 7 to project the discard 15 beyond the end face 1*a* of the container as seen in FIG. 9(VI). A shear blade 3 is lowered to cut off the discard 15 and is then raised. As illustrated in FIG. 9 (VII), the container 1 and container holder 2 are advanced toward the die stem 7 to project the die 8 outward from the container 1, and a die handling robot 10 is caused to grip the die. These procedures are exactly the same as those shown in FIGS. 1**(VI) and (VII). Thus, one press cycle is completed.

Figure 10:
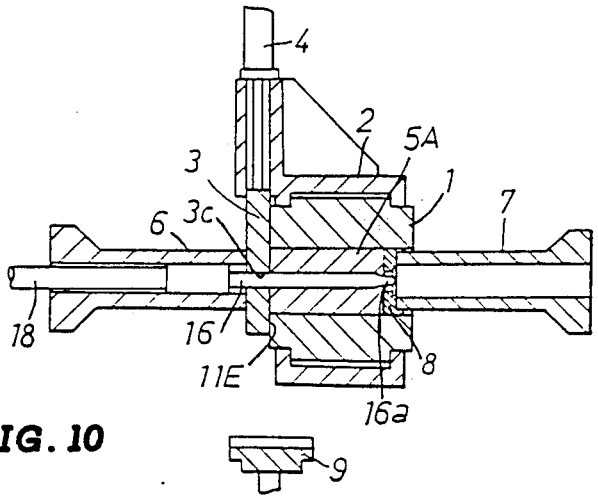
Figure 11:
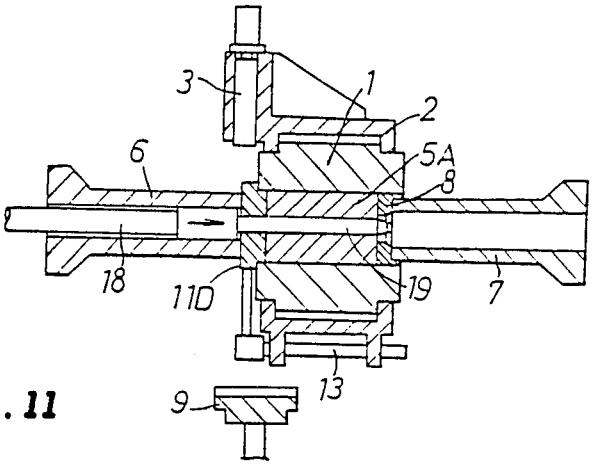

FIG. 10 shows an embodiment for extruding a hollow billet 5A into a tubular product 14A as in the embodiment of FIG. 9. As in the embodiment of FIG. 2, a portion of a shearing device mounted on a container holder 2 serves as the blister preventing closure 11 of this embodiment. The drawing shows the press in an upsetting state. A press stem 6 and mandrel 16 are advanced toward a container 1 to bring press stem 6 into bearing contact with a shear blade 3 for back-up. The mandrel 16 is singly advanced through a passing hole 3C to position a core head **16*a* in cooperative relation with a die 8 on a die stem 7. The hollow billet 5A** is upset by exactly the same actio and effect as in the foregoing embodiments.

FIGS. 11 to 14 correspond to FIG. 9(III) and show other embodiments in an upsetting state. While the embodiment of FIG. 9 includes a stationary mandrel for the arresting extrusion of hollow billets, the embodiment of FIG. 11 includes a floating mandrel 19 for the flow extrusion of a hollow billet 5A. The parts common to those shown in FIG. 9 are indicated by common reference numerals individually.

Figure 12:
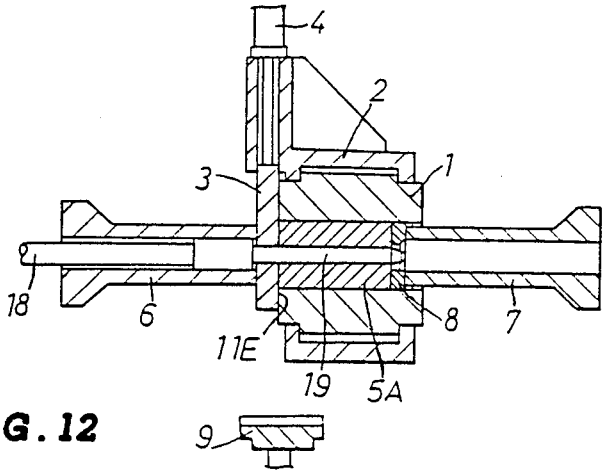

The embodiment of FIG. 12 corresponds to the embodiment shown in FIG. 10 and already described and inludes a flaoting mandrel 19 for the flow extrusion of a hollow billet 5A. The parts common to those in FIG. 10 are indicated by common reference numerals individually.

Figure 13:
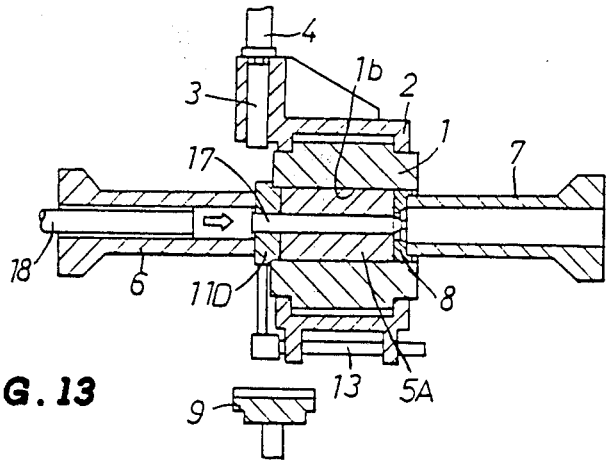

Whereas the embodiment of FIG. 9 is adapted for the arresting extrusion of the hollow billet 5A with use of a stationary mandrel, this embodiment is modified to the embodiment of FIG. 13 for flow extrusion. Otherwise, the two embodiments are incommon, so that the common parts are indicated by common reference numerals individually.

Figure 14:
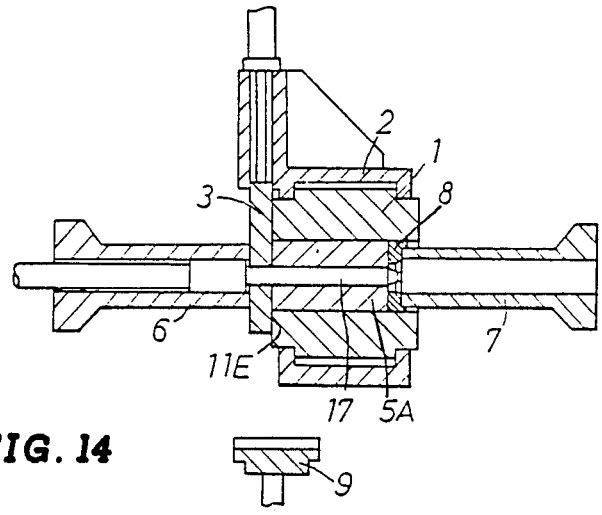

The embodiment shown in FIG. 14 differs from the embodiment described with reference to FIG. 10 in that a stationary mandrel is used for the flow extrusion of a hollow billet 5A. Otherwise, the two embodiments are in common, so that the common parts are referred to by common reference numerals individually. The tipped mandrels used for the embodiments of FIGS. 3 and 14 may be replaced by straight mandrels.

With any of the embodiments described above, the container 1 is closed at one end thereof remote from the die stem with a blister preventing closure member or surface, and the billet 5 or 5A enclosed in the container is subjected to a force at the die side while being backed up by the press stem 6, with the result that the billet starts yield deformation from the die side to fill up the space in the container. The deformation proceeds in a direction away from the die stem, whereby the air present between the container inner surface and the billet is completely expelled from the above-mentioned one end and discharged to the outside reliably and easily.

FIGS. 15 to 19 show indirect extrusion presses of the double stem type which embody the invention and which are adapted to extrude a solid billet into a tubular product by piercing as disclosed, for example, in Unexamined Japanese Patent Publication No. SHO 54-957 and Unexamined Japanese Utility Model Publication No. SHO 54-62538.

These embodiments, like those shown in FIGS. 1 to 14, are free of the likelihood that air will be confined in the container during peircing and extrusion steps, such that the billet starts yield deformation from the die side during upsetting to release air from the container at the dummy block side and to eliminate the blistering phenomenon that could result from the air confined in the container.

With reference to FIGS. 15 to 19, opposed frames (platens) 21, 22 are connected together by tie rods 20. A die stem 7 carrying a die 8 is supported by a die slide guide 23 on one of the frames, 21. The other frame 22 is integral with a main cylinder 24. A press stem 6 is supported by a crosshead 26 on a main ram 25 forwardly or rearwardly movably fitted in the main cylinder 24. A dummy block 27 is provided at the forward end in the direction of extrusion of the stem 6. The stem 6 includes a large-diameter portion 28 having an outside diameter larger than the inside diameter of a container 1 and positioned behind the dummy block 27. As illustrated in a fragmentary view included in FIG. 15, the large-diameter portion 28 of the present embodiment comprises a plurality of radial projections equidistantly arranged circumferentially of the stem to render a billet loader 9 movable forward or rearward along the center line of extrusion of the press stem 6 without interfering with the large-diameter portion 28. The billet loader 9 brings a billet 5 into alignment with the extrusion center line from outside the press.

Figure 15:
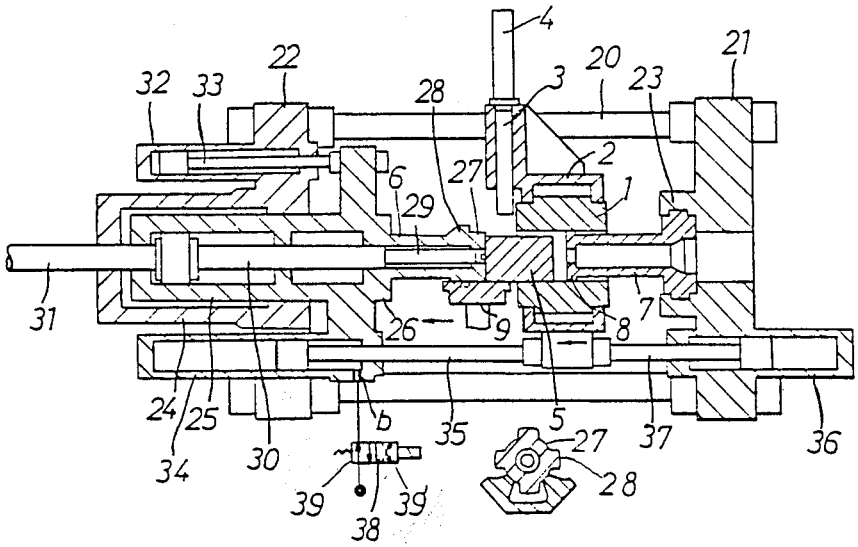
FIG. 15 to FIG. 19 are fragmentary views in section showing the press cycle motions of an embodiment of the present invention for piercing and extruding a solid billet to obtain a tubular product.

A piercing mandrel 29, a piercer piston rod 30 supporting the mandrel 29, and a piercer tail rod 31 in alignment with the center line extend through the main cylinder 24, the main ram 25, and the cross head 26 and are movable forward or rearward. The mandrel 29 is positioned within the press stem 6. Connected to the main ram 25 and the cross head 26 is the piston rod 33 of a side cylinder 32 mounted on the frame 22. The container 1 is held by a container holder 2, which is connected by a coupling to the piston rod 35 of a hydrocoupling cylinder 34 on the frame 22 and to the piston rod 37 on a shift cylinder 36 on the frame 21 and is movable forward or rearward. The above structure is known as a double-acting indirect extrusion press. Indicated at 38 in FIG. 15 is a control electromagnetic valve provided in a pressure fluid channel communicating with a port b in the hydrocoupling cylinder 34. Using the double-acting indirect extrusion press, the billet 5 is subjected to indirect extrusion in the following manner.

Figure 16:
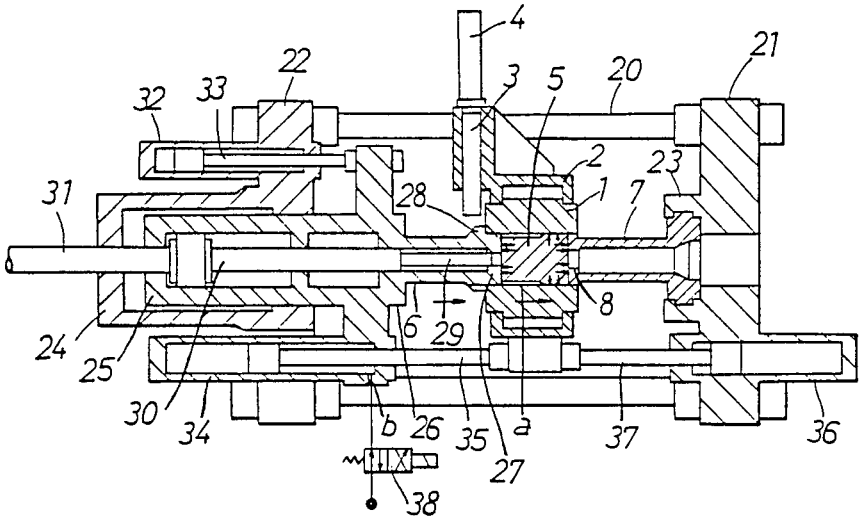
Figure 17:
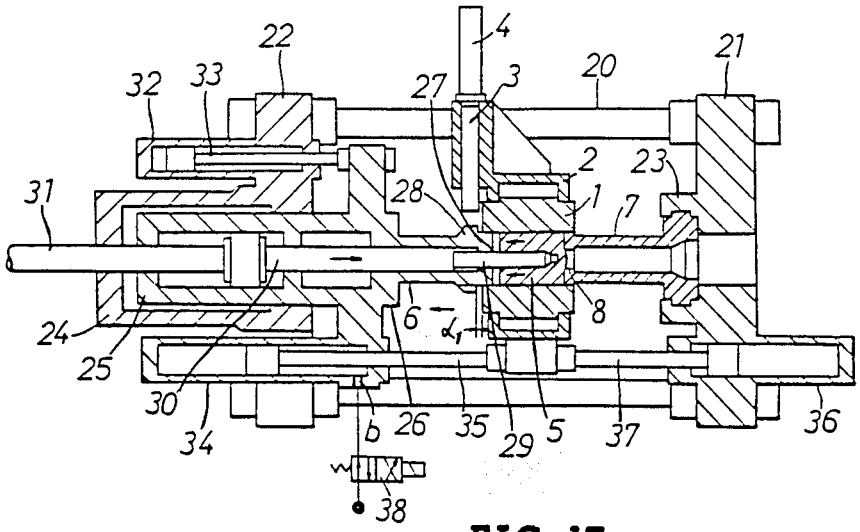

FIG. 15 shows the billet 5 while it is being fed. The billet 5 on the movable billet loader 9 is loaded into the container 1 by causing the shift cylinder 36 to move the container 1 toward the press stem 6 as indicated by an arrow. The billet 5 in the container 1 is upset as shown in FIG. 16. The main ram 25 is advanced, advacing the press stem 6 therewith to bring the dummy block 27 into bearing contract with the rear end face of the billet 5 in the container 1 and the large-diameter portion 28 into engagement with the rear end face of the container 1. This advances the container 1, bringing the front end face of the billet 5 into pressing contact with the die 8 of the die stem 7 in a fixed position and causing the press stem 6 and the die stem 7 to start upsetting the billet 5. At this time, the end of the container where the dummy block 27 is present is closed, so that at the billet end adjacent the dummy block 27, the stress of the billet given by the upsetting pressure is not inexcess of the deformation resistance. Accordingly the deformation of the billet 5 by the upsetting starts first in the vicinity of the die 8 on the die stem 7, whereby the air a present inside the container 1 is guided toward the dummy block 27 and released from the container although the air a would be confined in the midportion of the container if the billet is deformed from its opposite ends at the same time as practiced in the prior art. After the upsetting step has been completed in this manner, the billet 5 is pierced by the piercing mandrel 29 as illustrated in FIG. 17 which shows the press during piercing.

The press stem 6 is retracted by the main ram 25 as indicated by an illustrated arrow, by a distance corresponding to the amount of backflow of the billet which would expectedly result from piercing or by a slightly larger distance, to provide a clearance indicated at $\alpha_1$ in the drawing between the rear end face of the billet 5 and the front surface of the dummy block 27, as well as between the front surface of the large-diameter portion 28 and the rear end face of the container 1. With such clearances formed, the piercing mandrel 29 is advanced by the piercing rod 30 to pierce the billet 5. Whereas piercing causes a billet solid portion to leak toward the die 8, the presence of the clearances $\alpha_1$ diminishes such leakage.

Figure 18:
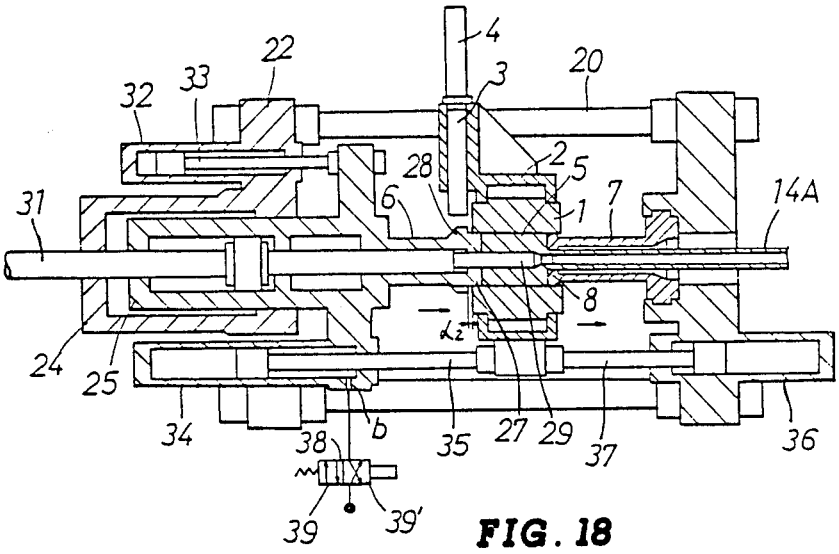

Completion of piercing is followed by extrusion as shown in FIG. 18, in which it is seen that the dummy block 27 is in contact with the billet 5 owing to the backflow due to piercing, while a clearance $\alpha_2$ sill remains between the large-diameter portion 28 and the rear end face of the container 1 as illustrated. With this clearance $\alpha_2$ maintained, the press stem 6 and the container 1 was advanced toward the die stem 7 as indicated by the arrows shown in FIG. 18 to start extrusion. Although the port b of the hydrocoupling cylinder 34 is held open as at 39 during the steps of billet loading, upsetting and piercing, the port is closed as at 39' by the valve 38 in the pressure fluid channel for the cylinder 39 to block the rod side and to thereby maintain the clearance $\alpha_2$. During the entire extrusion stroke producted by the main ram 25 which moves the press stem 6 forward as indicated by an arrow, the amount of force delivered by the rod 33 of the shift cylinder 36 is added to the force of extrusion, with the container 1 and the press stem 6 retained in a definite position relative to each other, i.e., with the clearance $\alpha_2$ maintained between the large-diameter portion 28 and the rear end face of the container 1. In this manner, a tubular product 14A is obtained by indirect extrusion. On completion of extrusion, the press stem 6 is retracted by the main ram 25, and the container 1 is moved by a shift cylinder 36 to remove a discard 15 from the rear end of the billet 5 by a discard cutting device mounted on the container holder 2.

Figure 19:
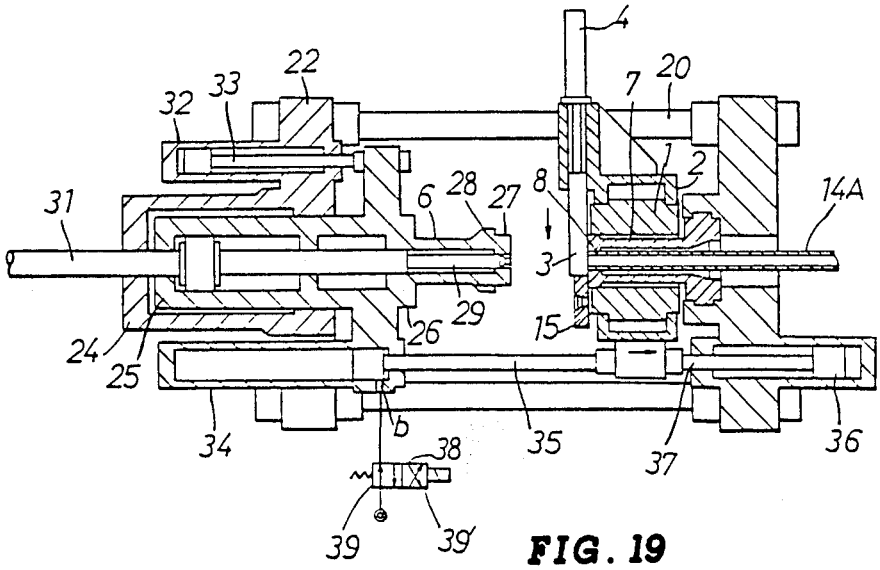

According to the illustrated embodiment, the discard 15 projected outward from the rear end of the container 1 by the movement of the container 1 is cut off from the extruded product 14A by lowering a shear blade 3 by a shear cylinder 4 as shown in FIG. 19, whereby one cycle of indirect extrusion is completed according to the invention. Throughout all the steps of upsetting, piercing and extrusion, the air a pressent inside the container 1 is reliably and completely expelled from the container 1 to eliminate the blistering phenomenon that would result if the air a is confined.

FIGS. 20 to 25 show arrangements for use in indirect extrusion presses of the type shonw in FIG. 15, by which a shell separated off and remaining in the press stem can be easily removed. FIGS. 26(I) and (II) are views for illustrating the problem. With reference to these drawings, a shell 40 adhering to the surface of the mandrel 16A during extrusion is inserted into the press stem 6 by relative motion. Even if the shell 40 can be removed from the mandrel 16A after extrusion as seen in FIG. 26(II), the removed shell 40 remains in the press stem 6. If the shell is a grown one, the mandrel is not usable. As will be apparent from the illustration, it is difficult to remove the shell.

Figure 20:
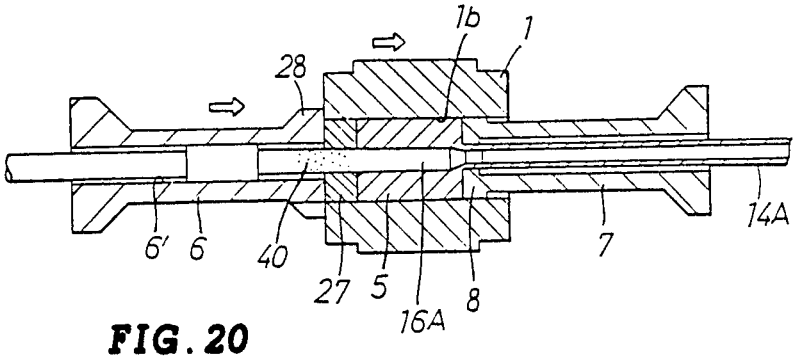
FIG. 20 to FIG. 25 are fragmentary views in section showing embodiments of the invention during extrusion for fabricating a tubular product, the embodiments being adapted to prevent blistering phenomena as chiefly contemplated by the invention and also to readily remove a shell separated off and remaining in the press stem.
Figure 21:
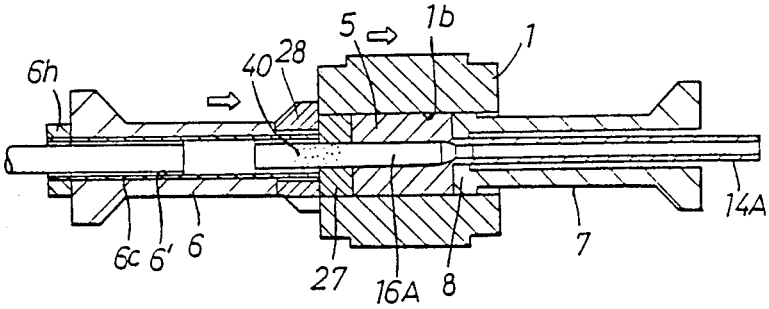

This problem is attributable to the structure that the dummy block 27 and the large-diameter portion 28 of the press stem 6 are integral. FIGS. 20 to 25 each show a dummy block 27 and a large-diameter portion 28 which can be joined to or separated from each other. The inner periphery 6' of the press stem 6 is larger than the mandrel **16*a* in diameter. In these drawings and the drawings already described, like parts are indicated by like reference numerals. The press stem 6 of FIG. 20 is integral with the large-diameter portion 28 at the front end of the press stem 6. With reference to FIG. 21, the large-diameter portion 28 at the front end of the press stem 6 is separate from the stem 6. The large-diameter portion 28 is internally threaded. A sleeve 6*c* extending through the press stem 6 has a front end screwed in the internally threaded portion and a rear end fastened to the rear end of the press stem 6 by a nut 6*h*. With the exception of the above feature, the arrangement is the same as the embodiment of FIG. 20**. Like parts are referred to by like reference numerals.

Figure 22:
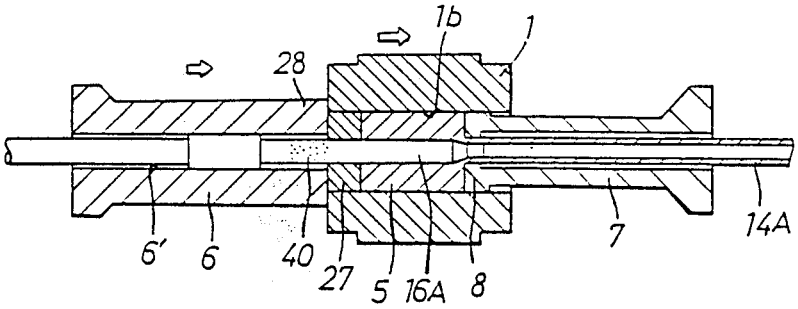
Figure 23:
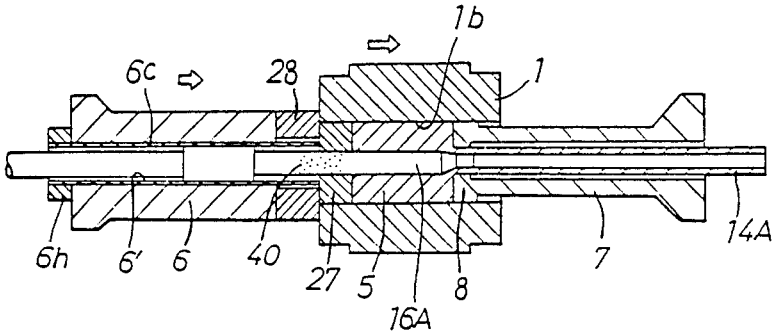
Figure 24:
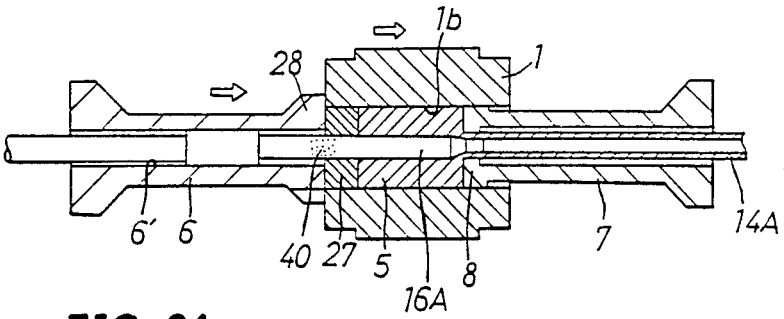

With reference to FIG. 22, the main body of the press stem 6 is in conformity with the large-diameter portion 28 in external shape. In FIG. 23, the main body of the press stem 6 is in conformity with the large-diameter portion 28 in external shape but is separate therefrom and joined thereto by a sleeve 6c. In FIG. 24, the billet 5 is solid.

The parts of the embodiments of FIGS. 22 to 24 which are common to those shown in FIGS. 20 or 21 are indicated by common reference numerals individually. Apparently, the mandrel can be of the floating or arresting type. FIGS. 20, 21, 22, 23 and 24 show billets being extruded, with a shell 40 adhering to the surface of the mandrel 16A.

Figure 25:
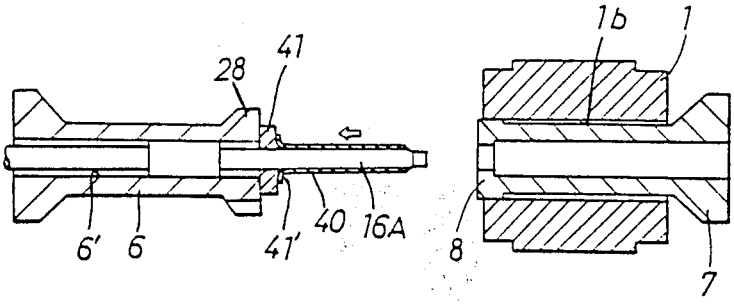

On completion of extrusion, the press stem and the mandrel means are retracted with the container 1 fitting around the die stem 7 as seen in FIG. 25. The discard is cut off from the product, and the discard and the dummy block 27 are placed onto an unillustrated tray or the like and delivered for treatment. On the other hand, the shell 40 must be recovered from the mandrel 16A for the next extrusion cycle.

The shell is removed by projecting the mandrel 16A from the pres stem 6. Since the inner peripheral surface 6' of the press stem 6 is straight and larger than the mandrel 16A in diameter, the shell 40 can be projected from the press stem 6 as retained on the mandrel 16A. After projection, a tool 41 having a tapered removing portion 41' comprising divided segments is fitted around the base portion of the mandrel 16A, and the tool 41 and the mandrel 16A are moved relative to each other axially thereof to remove the shell 40 from the mandrel 16A by the removing portion 41'.

The embodiments shown in FIGS. 20 to 25, which are used, for example, for indirect extrusion presses, are similarly useful for single-acting indirect extrusion presses. The piercing mandrel may be of the arresting type or the floating type. Either solid billets or hollow billets are usable as billets.

INDUSTRIAL APPLICATION

The indirect extrusion method and apparatus of the present invention are suited to the production of rod and tubular metal products.

We claim:

1. An indirect extrusion press of the double-stem type for forming a tubular product by extrusion, said indirect extrusion press comprising:

(a) a billet accommodating container;

(b) a press stem and a die stem arranged in opposed relation to each other on the center line of extrusion on opposite sides of said billet accommodating container so that, during use of said indirect extrusion press, a billet placed onto said billet accommodating container is upset by said press and die stems and thereafter extruded through a die on the forward end of said die stem by moving said billet accommodating container and said press stem together toward said die stem, said press stem having a longitudinally extending hole extending along its longitudinal axis, the surface of said longitudinally extending hole being parallel to the press direction, said press stem having at its container end a large-diameter portion larger than the opening in said billet accommodating container such that, during use of said indirect extrusion press, said large-diameter portion of said press stem abuts the adjacent end face of said billet accommodating container;

(c) a mandrel inserted in said longitudinally extending hole in said press stem and movable in the press direction, a gap being formed between the outer surface of said mandrel and the surface of said longitudinally extending hole;

(d) means for moving said mandrel axially into and out of said billet accommodating container so as to pierce a billet located in said billet accommodating container; and (e) a blister preventing closure means which comprises said large-diameter portion of said press stem and a dummy block mountable on said large-diameter portion of said press stem, said dummy block having a center hole sized, shaped, and positioned to allow said mandrel to extend therethrough with little clearance, said blister preventing closure means comprising a distal cylindrical portion and a proximal cylindrical portion, said proximal and distal cylindrical portions being concentric to one another and being joined by a planar annular shoulder the entirety of which is flat and perpendicular to the center line of extrusion, said proximal cylindrical portion having an outer diameter that is not fittable in the openign in said billet accommodating container and said distal cylindrical portion having an outer diameter that is fittable in the opening in said billet accommodating container and having a working surface that comes into contact with the billet during use of said indirect extrusion press, the entirety of said working surface being perpendicular to the center line of extrusion.

2. An indirect extrusion press as defined in claim 1 wherein said large-diameter portion of said press stem serving as part of said blister preventing closure means is integral with said press stem.

3. An indirect extrusion press as defined in claim 1 wherein said large-diameter portion of said press stem serving as part of said blister preventing closure means has the same diameter as said press stem and is integral with said press stem.

4. An indirect extrusion press as defined in claim 1 wherein said large-diameter portion of said press stem serving as part of said blister preventing closure means is separate from said press stem.

* * * * *

UNITED STATES PATENT AND TRADEMARK OFFICE

CERTIFICATE OF CORRECTION

PATENT NO. : 4,744,236

DATED : May 17, 1988

INVENTOR(S) : Asari et al.

It is certified that error appears in the above-identified patent and that said Letters Patent is hereby corrected as shown below:

On the face of the patent, at item [30], indicate Japanese Application Nos. 59-58949 and 59-87754 as being Utility Model Applications.

Column 1, line 33, after "platen" insert --at the right of the drawing and a press frame at the left--.

Column 12, lines 35 and 38, change "air a" to --air a--; Column 12, line 35, correct the spelling of "present"; an.. line 40, correct the spelling of "shown".

Signed and Sealed this

Eighth Day of November, 1988

*Attest:*

DONALD J. QUIGG

*Attesting Officer*

*Commissioner of Patents and Trademarks*